United States Patent [19]

Simeth

[11] 4,399,767

[45] Aug. 23, 1983

[54] VARNISHING UNIT IN THE DELIVERY UNIT OF A SHEET-FED ROTARY PRINTING PRESS

[75] Inventor: Claus Simeth, Offenbach am Main, Fed. Rep. of Germany

[73] Assignee: M.A.N.-Roland Druckmaschinen Aktiengesellschaft, Fed. Rep. of Germany

[21] Appl. No.: 386,656

[22] Filed: Jun. 9, 1982

Related U.S. Application Data

[63] Continuation-in-part of Ser. No. 374,150, May 3, 1982, abandoned.

[30] Foreign Application Priority Data

May 6, 1981 [DE] Fed. Rep. of Germany ..... 3117855

[51] Int. Cl.[3] ..... B05C 11/00

[52] U.S. Cl. ..... 118/46; 101/232; 118/236; 118/239; 118/249

[58] Field of Search ..... 118/46, 236, 239, 249; 101/232

[56] References Cited

U.S. PATENT DOCUMENTS 3,931,791 1/1976 Preuss et al. ..... 118/236

FOREIGN PATENT DOCUMENTS 1930317 1/1970 Fed. Rep. of Germany .
2020584 2/1972 Fed. Rep. of Germany .
2345183 8/1974 Fed. Rep. of Germany .

*Primary Examiner*—Evan K. Lawrence

*Attorney, Agent, or Firm*—Leydig, Voit, Osann, Mayer & Holt, Ltd.

[57] ABSTRACT

An apparatus for varnishing a sheet being fed from a sheet fed printing press into a delivery unit, the sheet being conveyed by an endless loop conveyor made up of a pair of laterally spaced conveyor chains. Cross members extend between the chains at regular intervals carrying grippers for the leading edge of successive sheets. The chains are guided to form a delivery run and a return run spaced apart and generally parallel to one another. An applicator cylinder is journalled between the runs having an axial length which is shorter than the lateral spacing between the chains. A plate cylinder journalled in the frame outside of the return run is in rolling engagement with the applicator cylinder for supplying a varnish film thereto. A backing cylinder journalled in the frame outside of the delivery run is in rolling engagement with the applicator cylinder. The circumference of the cylinders equals the spacing between successive cross members and grippers. The applicator, plate, and backing cylinders have respective longitudinal grooves sufficiently large to provide free passage for the cross members and associated grippers. The cylinders are driven synchronously with the conveyor chains so that a sheet passing on the grippers is engaged between the applicator and backing cylinders for application of varnish to the sheet. The conveyor speed is less than the press speed in a predetermined ratio. The cylinders have a diameter less than the diameter of the cylinders in the associated press unit in the same ratio.

10 Claims, 5 Drawing Figures

DRIVE
GRIPPER RELEASE
P
L
S
C D
1a
1a 24
24
54
38

101
52
42
34
53
26
37
32
41
55
43
31
39
33
103
27
28

80
81
60
55
83'
73
53
31
72
63
62
39
66
61
67
83
62'
63'
61'
65
82
70
85
90
33
96
71
91
CK
V
93
S
OPERATE
DISABLE
92
95
P

VARNISHING UNIT IN THE DELIVERY UNIT OF A SHEET-FED ROTARY PRINTING PRESS

This application is a continuation-in-part of application Ser. No. 374,150, filed May 3, 1982, abandoned.

It is known to modify a damping unit in the last printing unit of a printing press to apply varnish to a printed sheet. It is also known to use a separate varnishing unit in the path of the sheets being conveyed from the printing press to the delivery unit.

German Pat. No. 2,020,584 shows application of varnish by the dampening unit of the last printing unit, by a varnishing unit on the last blanket cylinder and by a varnishing unit on a separate sheet guide cylinder. In each case, however, varnishing is at the expense of the last printing unit in the press which must be cut out or modified. An additional printing unit for the application of varnish downstream of the last ink printing unit requires two additional transfer stations, which is quite costly in addition to complicating the construction and maintenance of the machine.

German Pat. No. 2,345,183 describes a varnishing unit which is mounted in the delivery unit instead of in the printing unit. However this requires an additional sheet transfer comprising a transfer and take-off drum with grippers and control means. Again, the machine is quite complicated and costly.

German Pat. No. 1,930,317 teaches the possibility of conveying printed sheets through a number of printing units successively in one gripper operation by means of a transportation system consisting of chains, grippers and guides. However this is a costly system since it acquires large reversing wheels at the ends of the machine to enable the empty run of the transportation system to be returned beneath the printing units.

It is, accordingly, an object of the present invention to provide a simple and readily accessible arrangement for accurate-register varnishing which can be incorporated in the delivery unit of the sheet fed printing press without any appreciable expense in terms of space and material, while the printing units of the machine are not required to be modified or disabled and hence are always available for printing. It is a related object to provide means for achieving accurate-register varnishing which does not require the use of auxiliary transfers by transfer drums of the like and during which the varnishing takes place as a sheet follows a straight line conveyance path.

It is more particularly an object of the invention to provide a varnishing means for use in a delivery which employs a minimum number of parts, which is easily installed and serviced with convenient access, and which is capable of being economically installed in new delivery units or, on a retrofit basis, in units already in the field to provide the advantages of varnishing at lowest possible cost.

It is still another object of the present invention to provide a device of the type described which is highly compact, a device in which both the delivery run and return run of the conveyor have free passage through a groove in the applicator cylinder without necessity for any special synchronizing means, and in which the cylinders are so arranged as to facilitate impression adjustment and throw off.

Other objects and advantages of the invention will become apparent upon reading the attached detailed description and upon reference to the drawings in which:

FIG. 1 is an elevational view, somewhat diagrammatic, of a delivery unit for a printing press incorporating provision for varnishing in accordance with the present invention.

FIG. 1*a* is a partial top view of the delivery unit shown in FIG. 1 looking down along the line 1*a*—*1a* therein.

FIG. 1*b* is a fragment showing free passage of cross member and grippers in the return run.

While the invention has been described in connection with a preferred embodiment, it will be understood that I do not intend to be limited to the particular embodiment shown but intend, on the contrary, to cover the various alternative and equivalent constructions included within the spirit and scope of the appended claims.

Figures 1, 1A, 1B:
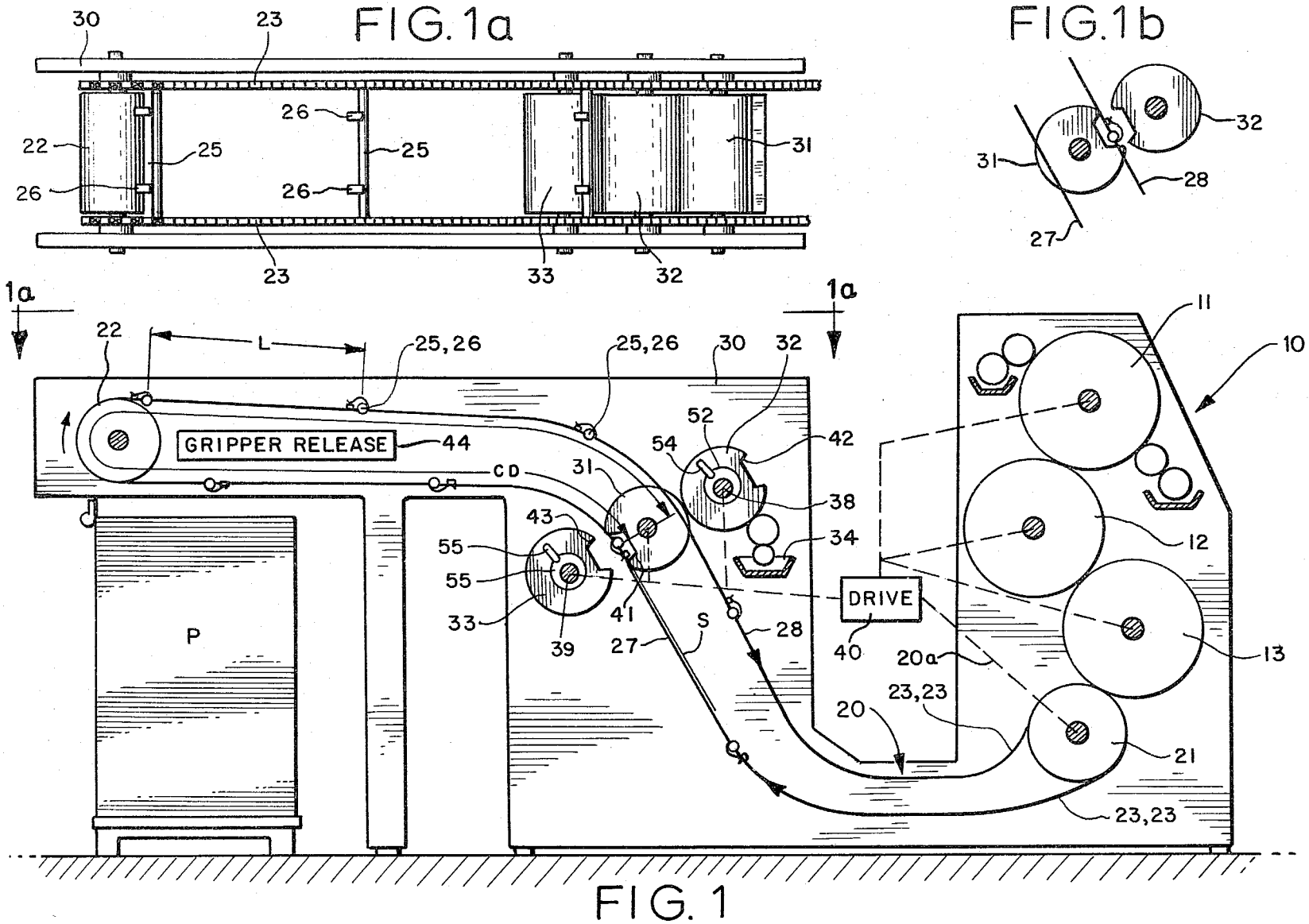

Turning now to FIG. 1 of the drawings there is shown, in diagrammatic form, a lithographic printing press unit 10 having the usual plate cylinder 11, blanket cylinder 12 and impression cylinder 13. This unit, either acting alone or in tandem with preceding press units, achieves printing on at least one side of the sheet, the sheet being indicated as S. The printing unit 10 discharges into a conveyor 20 having an input drum 21 and output drum 22. The conveyor is formed of a pair of laterally spaced closed loops of conveyor chain 23 which are trained around sprockets on the drums, the chains being guided between the drums along guide rails 24 (see also FIG. 2). Extending between the loops of chain 23 are cross members 25 which are spaced at equal intervals along the entire length of the chain, the cross members carrying pairs of grippers 26 which grip and transport the leading edges of successive sheets. The conveyor chains are supported to form a relatively straight and parallel delivery run 27 leading from the press unit to the pile P and an idle or return run 28.

In accordance with the present invention an applicator cylinder is journalled in the frame 30 of the delivery unit between the runs 27, 28 and having an axial length which is shorter than the lateral spacing between the chains. A plate cylinder journalled in the frame outside of the return run 28 is in rolling engagement with the applicator cylinder. A backing cylinder is journalled in the frame outside of the delivery run 27 for rolling engagement with the applicator cylinder. The circumference of the plate cylinder, applicator cylinder and backing cylinder is the same and equal to the spacing between successive grippers or cross members. At least the applicator cylinder has a longitudinal groove of sufficient size to provide free passage for the cross members and their associated grippers. The cylinders are driven in synchronism with the conveyor chains so that a sheet passing on the grippers is engaged between the applicator and backing cylinder for application of a film of varnish to the face of the sheet.

Figure 2:
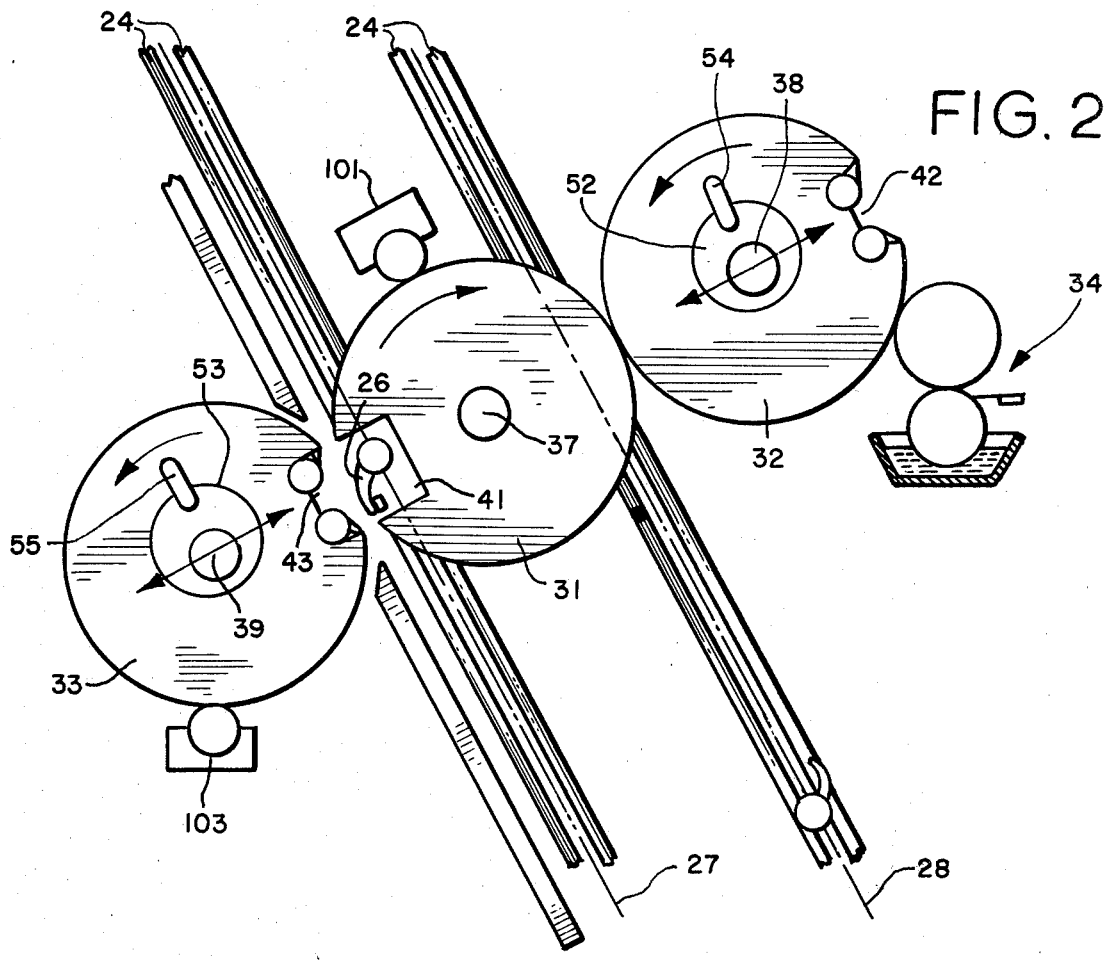
FIG. 2 is an enlarged view of a portion of FIG. 1.

Thus, referring to FIGS. 1 and 2, an applicator cylinder 31 is journalled in the frame 30 of the delivery unit between the runs 27, 28, the applicator cylinder having an axial length which is shorter than the lateral spacing between the chains (see FIG. 1*a*). For furnishing a film of varnish to the applicator cylinder a plate cylinder 32 is provided, the cylinder being journalled outside of the return run 28. For applying back up as the sheet is engaged by the applicator cylinder, a backing cylinder 33 is located outside of the delivery run 27.

A varnish fountain 34 acts as a source of varnish for the plate cylinder 32. The plate cylinder 32 carries plates (not shown) which accurately determine the area of the applicator cylinder to which varnish is supplied which, in turn, determines the area over which varnish is applied to the sheet S. The cylinders have respective shafts 37, 38 and 39. As stated, the circumference of each of the cylinders is equal to the spacing L of the successive grippers and cross members. The cylinders and conveyor have a common drive 40.

The conveyor drive connection 20*a* which drives the conveyor 20 is such that the speed of the conveyor is less than press speed in a predetermined ratio. The applicator cylinder 31, plate cylinder 32 and backing cylinder 33 have a diameter and surface speed which is less than the diameter and surface speed of the cylinders in the associated press unit 10 in the same ratio.

In carrying out the invention the applicator cylinder 31 is provided with a groove 41 large enough to provide free passage for the cross members 25 and the grippers 26 thereon in the delivery run 27. The plate cylinder 32 and backing cylinder 33 have mating grooves 42, 43 respectively which are preferably of similar span.

In operation, with the cylinders 31–33 driven in synchronism with the conveyor chains, the cross members and grippers pass freely between the cylinders 31, 33 and a sheet S, passing on the grippers is engaged between the applicator and backing cylinders for application of a film of varnish to the face of the sheet. When the sheet leaves the cylinders 31, 33 it passes to a position above the delivery pile P where the grippers are released by an automatic gripper release mechanism 44 so that the sheet is deposited on the pile. The grippers thus return empty over the upper, or return run 28 of the conveyor.

In accordance with one of the aspects of the invention in its preferred embodiment, the spacing between the delivery run 27 and the return run 28 is less than the diameter of the applicator cylinder 31 so that the applicator cylinder is more or less symmetrically overlapped by each of the runs. The length of the conveyor delivery and return loop defined by the applicator cylinder, and indicated at CD in FIG. 1, is preferably equal to $NL+L/2$ where N is a low integer and L is the gripper-to-gripper spacing so that the cross members and grippers passing in the return run are freely and idly accommodated in the groove 41 of the applicator cylinder and in the mating groove 42 of the plate cylinder which rotate in synchronism with one another. This condition of idle accommodation is shown in FIG. 1*b*. In short, the successive cross members and grippers are accommodated in the groove 41 of the applicator cylinder 31 in both the delivery and return directions resulting in a high degree of compactness of the assembly. The fact that the three cylinders 31, 32 and 33 are of a diameter less than the diameter of the cylinders in the regular printing press unit 10 similarly contributes to compactness.

For the purpose of adjusting the plate cylinder 32 back and forth with respect to the applicator cylinder 31, an eccentric sleeve 52 is provided. Moreover, for adjusting the backing cylinder in a direction toward and away from the applicator cylinder, a similar eccentric sleeve 53 is provided. Such sleeves, having operating handles 54, 55 respectively, are duplicated at the opposite ends of the cylinders. Slight rocking movement of the sleeve 52 increases, or decreases, the impression of the plate cylinder with respect to the applicator cylinder, while rocking the eccentric sleeve 53 of the backing cylinder, on the other hand, provides independent control of the impression between the backing and applicator cylinders.

Figure 3:
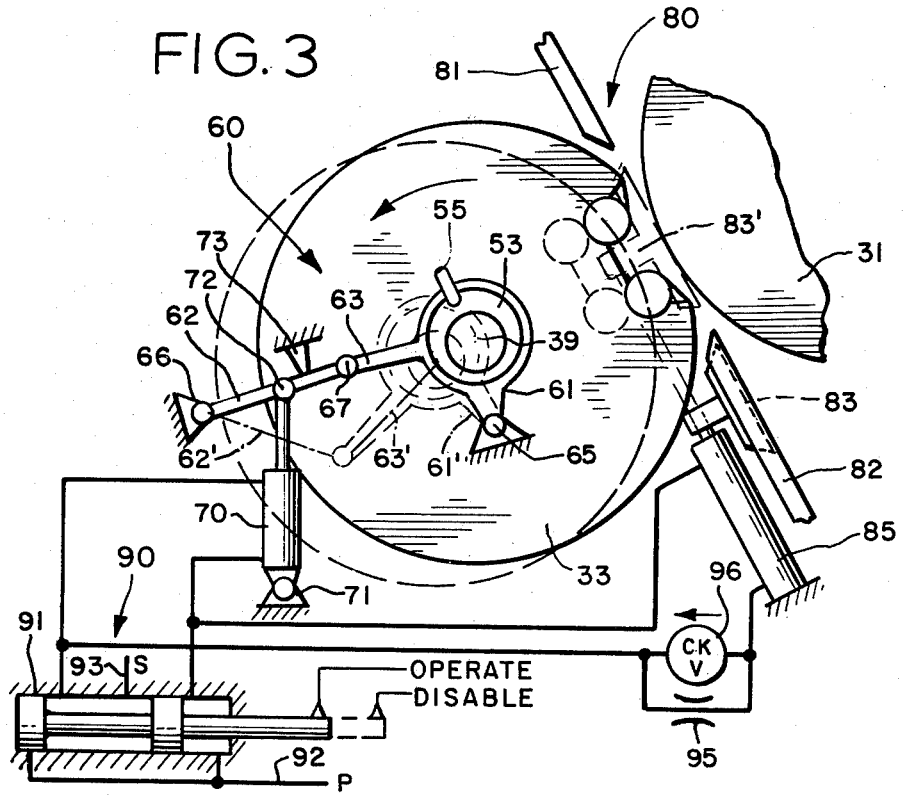
FIG. 3 is a further enlargement showing the provision for throw-off of the backing cylinder and the simultaneous insertion of a sheet guide segment.

In accordance with one of the detailed aspects of the present invention the backing cylinder 33 is mounted upon a swingable throw-off linkage for swinging between a working position in which the backing cylinder is in engagement with the applicator cylinder and a retracted position in which the backing cylinder is spaced at least 20 millimeters away from the applicator cylinder. The linkage in the present instance, generally indicated by the numeral 60 (FIG. 3), includes a first arm 61 which mounts the shaft 39 of the cylinder, a second or actuating arm 62, and an intermediate link 63. The arms 61, 62 are pivoted to the frame of the machine at pivots 65, 66 respectively, while the arm 62 is connected to the link 63 by a pivot 67.

For the purpose of swinging the actuator arm 62 from its retracted position to the illustrated working position, a pneumatic or hydraulic actuator 70 is used pivoted to the frame at 71 and pinned, at 72, to the central portion of the arm 62. A limit stop, or reference stop, 73 defines the limit of movement of the arm 62 slightly beyond dead center and hence the degree of extension of the actuator.

When the actuator 70 is in its expanded state, the eccentric sleeve 52 is in working position but subject to rocking movement for control of impression as discussed above. When the actuator 70 is, on the other hand, contracted, the arm 62 is drawn away from the stop 73 and the elements comprising the linkage 60 retreat to the retracted positions 61', 62' and 63' shown by the dotted lines in FIG. 3. Using the geometry shown, the backing cylinder will be withdrawn from the applicator cylinder by an amount which substantially exceeds 20 millimeters.

As a further feature of the invention the throw-off mechanism includes a sheet guide segment with means for interposing the segment between the backing cylinder and the applicator cylinder as the backing cylinder is retracted, so that the sheet is not pressed into engagement with the applicator cylinder and does not receive any varnish. Thus, referring again to FIG. 3, the sheet guide 80 normally consists of two spaced sections 81, 82 having a gap between them enabling the backing and applicator cylinders 31, 33 to engage one another. In carrying out the invention a bridging segment 83 is provided mounted on the plunger of an auxiliary actuator 85 so that the segment 83 normally occupies its retracted position but, upon extension of the actuator 85, occupies its bridging position 83' shown by the dotted outline.

The movements of the actuators 70, 85 may be coordinated by connecting them in a hydraulic circuit generally indicated at 90 having a spool valve 91 connected to a source of pressurized fluid 92 and to a sump 93. In the condition of the mechanism illustrated in FIG. 3 the actuator 70 is pressurized for extension and the actuator 85 is pressurized for retraction, which is the operating condition. When it is desired to retract the blanket cylinder, the spool in the valve 91 is shifted into the dotted "disable" position in which the actuator 70 is pressurized for retraction and the actuator 85 is pressurized for extension. When it is desired to retract the backing cylinder, the spool in the valve 91 is shifted into the dotted "disable" position in which the actuator 70 is pressurized for retraction and the actuator 85 is pressurized for extension. A restriction 95 in the line leading the actuator 85 ensures a time delay in the extension of the guide segment to permit time for the backing cylinder to get out of the way. The restriction 95 is, however, bypassed by a check valve 96 to ensure rapid retraction of the guide segment when the backing cylinder is moving back into its operating position.

The thickness of the film of the varnish applied by the applicator cylinder to the sheet is dependent, in part, upon the surface of the applicator cylinder. A minimum of varnish is applied when the surface of the applicator cylinder is smoothly polished. A maximum is applied when the applicator cylinder has a matt or "screened" surface. In accordance with one of the aspects of the present invention the applicator cylinder has means for alternatively mounting thereon replaceable surface elements of conforming cylindrical shape having (a) a smooth polished surface and (b) a matte surface, respectively. In the simplest aspect of the invention the wrap-around elements may be in the form of a thin metal sheet (not shown) of the wrap-around type, with the ends of the sheet being held by any convenient flexible plate lockup of conventional design (also not shown).

To facilitate clean up, separate washing units 101, 103 may be mounted for bringing into engagement with the surfaces of the applicator cylinder 31 and a backing cylinder 33, respectively, it being understood that such washing units are per se well known in the art. In practice the backing cylinder 33 is covered with a resilient blanket which may be substituted by a blanket having a different degree of stiffness, as desired. The term "guide rails" as used herein referes to any means which may be used to guide the conveyor chains along predetermined delivery and return runs.

It will be apparent that the objects of the invention have been amply fulfilled. The varnishing cylinders in the delivery accomplish accurate-register varnishing cheaply, conveniently and compactly saving the expense of a separate varnishing unit. When varnish is not required it is a simple matter to throw the control valve 91 into its "disable" position, protection being automatically provided for the passing sheet.

I claim:

1. An apparatus for varnishing a sheet being fed from a sheet-fed printing press unit into a delivery unit comprising, in combination, a frame, guide rails in the frame, a pair of conveyor chains laterally spaced from one another on the guide rails to form an endless loop conveyor extending from the press unit to a delivery pile, the chains having cross members at regular intervals, grippers at the cross members for gripping the leading edge of a sheet, the guide rails being arranged to form a delivery run and return run spaced apart and generally parallel to one another, an applicator cylinder journalled in the frame in a position in which it is overlapped by each of the runs but having an axial length which is shorter than the lateral spacing between the chains, means supported on the frame outside of the return run and in rolling engagement with the applicator cylinder for supplying a film of varnish thereto, a backing cylinder journalled in the frame outside of the delivery run and in rolling engagement with the applicator cylinder, the circumference of the cylinders being equal to the spacing between the successive cross members and grippers, the applicator cylinder having a longitudinal groove sufficiently large to provide free passage for the cross members and associated grippers in both the delivery run and the return run, means for driving the cylinders in synchronism with the conveyor chains so that a sheet passing on the grippers is engaged between the applicator and backing cylinders for application of varnish to the sheet.

2. An apparatus for varnishing a sheet being fed from a sheet-fed printing press unit into a delivery unit comprising, in combination, a frame, guide rails in the frame, a pair of conveyor chains laterally spaced from one another on the guide rails to form an endless loop conveyor extending from the press unit to a delivery pile, the chains having cross members at regular intervals, grippers at the cross members for gripping the leading edge of a sheet, the guide rails being arranged to form a delivery run and return run spaced apart and generally parallel to one another, an applicator cylinder journalled in the frame between the runs having an axial length which is shorter than the lateral spacing between the chains, means supported on the frame outside of the return run and in rolling engagement with the applicator cylinder for supplying a film of varnish thereto, a backing cylinder journalled in the frame outside of the delivery run and in rolling engagement with the applicator cylinder, the circumference of the cylinders being equal to the spacing between the successive cross members and grippers, the applicator and backing cylinders having respective longitudinal grooves sufficiently large to provide free passage for the cross members and associated grippers, means for driving the cylinders in synchronism with the conveyor chains so that a sheet passing on the grippers is engaged between the applicator and backing cylinders for application of varnish to the sheet.

3. The combination as claimed in claim 1 or in claim 2 in which the speed of the conveyor is less than press speed in a predetermined ratio, the cylinders being of the same diameter and surface speed, which diameter and surface speed is less than the diameter and surface speed of the cylinders in the associated press unit in the same ratio.

4. The combination as claimed in claim 1 or in claim 2, the spacing between the delivery run and the return run being somewhat less than the diameter of the applicator cylinder so that the applicator cylinder is symmetrically overlapped by each of the runs, the length of the conveyor delivery and return loop defined by the applicator cylinder being equal to $NL+L/2$ where N is a low integer and L is the gripper-to-gripper spacing so that cross members and grippers passing in the return run are idly accommodated in the groove of the applicator cylinder.

5. The combination as claimed in claim 1 or in claim 2 in which the means for supplying a film of varnish includes a plate cylinder.

6. The combination as claimed in claim 1 or in claim 2 in which the backing cylinder is mounted upon a swingable throw-off linkage including a toggle for swinging between a working position in which the backing cylinder is in engagement with the applicator cylinder with the toggle on center and a retracted position in which the backing cylinder is spaced at least 20 millimeters away from the applicator cylinder.

7. The combination as claimed in claim 1 or in claim 2 in which the backing cylinder is mounted upon a swingable throw-off linkage including a toggle for swinging between a working position in which the backing cylinder is in engagement with the applicator cylinder with the toggle on center and a retracted position in which the backing cylinder is spaced at least 20 millimeters away from the applicator cylinder and in which the throw-off mechanism includes a sheet guide segment with means for interposing the segment between the backing cylinder and the applicator cylinder as the backing cylinder is retracted so that the sheet is held safely away from the applicator cylinder free of transfer of any varnish therefrom.

8. The combination as claimed in claim 1 or claim 2 in which the applicator cylinder has a smooth polished surface.

9. The combination as claimed in claim 1 or claim 2 in which the applicator cylinder has a matte surface.

10. The combination as claimed in claim 1 or claim 2 in which the applicator cylinder has means for alternatively mounting thereon replaceable surface elements of conforming cylindrical shape having (a) a smooth polished surface and (b) a matte surface, respectively.

* * * * *